US008371883B2

(12) United States Patent
Kimura

(10) Patent No.: US 8,371,883 B2
(45) Date of Patent: Feb. 12, 2013

(54) CONNECTOR ASSEMBLY

(75) Inventor: Akinori Kimura, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 13/246,272

(22) Filed: Sep. 27, 2011

(65) Prior Publication Data

US 2012/0083167 A1 Apr. 5, 2012

(30) Foreign Application Priority Data

Sep. 30, 2010 (JP) ..... 2010-222461

(51) Int. Cl.
*H01R 11/22* (2006.01)

(52) U.S. Cl. ..... 439/852; 439/884

(58) Field of Classification Search ..... 439/851–852, 439/884, 857, 858, 862–867, 877, 888
See application file for complete search history.

(56) References Cited

U.S. PATENT DOCUMENTS

| | | | |
|---|---|---|---|
| 5,888,106 | A | 3/1999 | Ono et al. |
| 6,547,608 | B2 | 4/2003 | Sato et al. |
| 6,869,312 | B2 | 3/2005 | Hasebe |
| 7,867,029 | B2 | 1/2011 | Takahashi et al. |

FOREIGN PATENT DOCUMENTS

| | | | |
|---|---|---|---|
| JP | 50-075088 | U | 11/1975 |
| JP | 59-017570 | U | 2/1984 |
| JP | 63-232280 | A | 9/1988 |
| JP | 5-087837 | U | 11/1993 |
| JP | 8-124633 | A | 5/1996 |
| JP | 8-162194 | A | 6/1996 |
| JP | 2000-021516 | A | 1/2000 |
| JP | 2002-063961 | A | 2/2002 |
| JP | 2002-298964 | A | 10/2002 |
| JP | 2004-281207 | A | 10/2004 |
| JP | 2007-184156 | A | 7/2007 |
| JP | 2009-105011 | A | 5/2009 |
| JP | 2010-055880 | A | 3/2010 |

OTHER PUBLICATIONS

Japanese Office Action dated Aug. 9, 2012 and English translation thereof in counterpart Japanese Application No. 2010-222461.

*Primary Examiner* — Khiem Nguyen
(74) *Attorney, Agent, or Firm* — Holtz, Holtz, Goodman & Chick PC

(57) ABSTRACT

A first connector has a housing holding a female contact. A second connector has a housing holding a male contact. The connectors are connected to each other by inserting the male contact into the female contact along an insertion direction. The female contact has a support portion and a spring portion having a contact point. The spring portion is located above the support portion in the vertical direction. The male contact is insertable between the spring portion and the support portion. The male contact has a contact portion, a tip, an upper slope and a lower slope. The contact portion contacts the contact point when the male contact is inserted into the female contact. The upper slope extends from the tip to the contact portion, sloping over a first tapering range. The lower slope extends from the tip to the contact portion, sloping over a shorter second tapering range.

6 Claims, 9 Drawing Sheets

CONNECTOR ASSEMBLY

CROSS REFERENCE TO RELATED APPLICATIONS

Applicants claim priority under 35 U.S.C. §119 of Japanese Patent Application No. JP2010-222461 filed Sep. 30, 2010.

BACKGROUND OF THE INVENTION

This invention relates to a connector assembly comprising two connectors which are configured to be mated with and connected to each other.

For example, a connector assembly of this type is disclosed in JP-A 2004-281207 or JP-A 2009-105011, contents of which are incorporated herein by reference. The connector assembly of JP-A 2004-281207 or JP-A 2009-105011 comprises a first connector having a female contact (socket contact) and a second connector having a male contact (pin contact). The female contact of the first connector is configured to be inserted into and connected to the male contact of the second connector along an insertion direction.

The female contact of JP-A 2004-281207 includes a support portion formed on a lower side thereof and a spring portion formed on an upper side thereof. The support portion is formed with a first protrusion and a second protrusion each protruding upward. The spring portion is formed with a contact point. The contact point is located between the first protrusion and the second protrusion in the insertion direction. The male contact inserted in the female contact is held by the contact point, the first protrusion and the second protrusion so that a stable connection of the male contact to the female contact can be realized.

The male contact of JP-A 2009-105011 includes a tip, a contact portion and a head portion extending from the contact portion to the tip along the insertion direction. The head portion tapers off toward the tip while the contact portion has a rectangular cross-section. The head portion of the male contact is thus shaped so that the male contact is able to be inserted into the female contact by an insertion force smaller than an insertion force which is necessary to insert a male contact with no head portion into the female contact.

However, it is more preferable that the connectivity of the male contact with the female contact is further improved.

SUMMARY OF THE INVENTION

It is therefore an object of the present invention to provide an improved connector assembly including a female contact and a male contact. The male contact is inserted into the female contact with a smaller insertion force. The male contact is connected to the female contact more stably. Moreover, the connection of the male contact to the female contact is maintained securely.

One aspect of the present invention provides a connector assembly comprising a first connector and a second connector. The first connector includes a female contact and a first housing. The first housing holds the female contact so that the female contact extends along an insertion direction. The female contact has a support portion and a spring portion. The spring portion is formed to be located above the support portion in a vertical direction perpendicular to the insertion direction so that the female contact is formed with a gap between the spring portion and the support portion. The support portion has an upward portion and a downward portion formed so as to be located apart from each other in the insertion direction. Each of the upward portion and the downward portion has a highest point in the vertical direction. The spring portion has a contact point formed to be located between the highest point of the upward portion and the highest point of the downward portion in the insertion direction. The second connector includes a male contact and a second housing. The second housing holds the male contact so that the male contact is insertable into the gap of the female contact along the insertion direction. The second connector is configured to be mated with and connected to the first connector under an inserted state where the male contact is inserted in the female contact. The male contact has a contact portion, a tip, an upper slope and a lower slope. The contact portion is brought into contact with the contact point, the highest point of the upward portion and the highest point of the downward portion under the inserted state. The upper slope extends from the tip to the contact portion while sloping over a first tapering range. The lower slope extends from the tip to the contact portion while sloping over a second tapering range. The first tapering range is longer than the second tapering range in the insertion direction.

An appreciation of the objectives of the present invention and a more complete understanding of its structure may be had by studying the following description of the preferred embodiment and by referring to the accompanying drawings.

Figure 1:
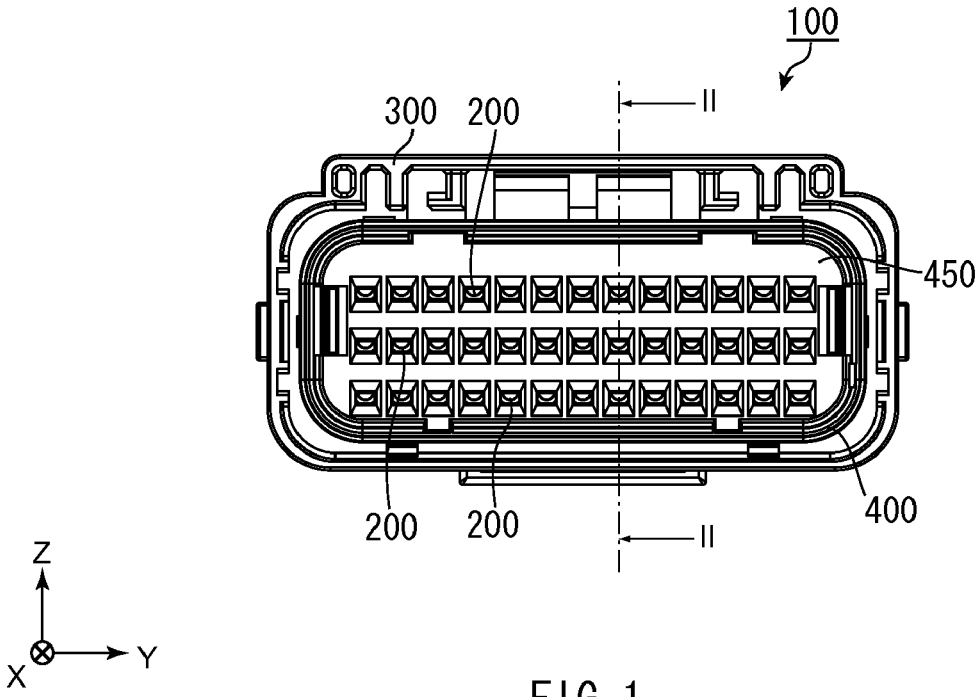
FIG. 1 is a front view showing a first connector of a connector assembly according to an embodiment of the present invention.

While the invention is susceptible to various modifications and alternative forms, specific embodiments thereof are shown by way of example in the drawings and will herein be described in detail. It should be understood, however, that the drawings and detailed description thereto are not intended to limit the invention to the particular form disclosed, but on the contrary, the intention is to cover all modifications, equivalents and alternatives falling within the spirit and scope of the present invention as defined by the appended claims.

DESCRIPTION OF PREFERRED EMBODIMENTS

Figure 2:
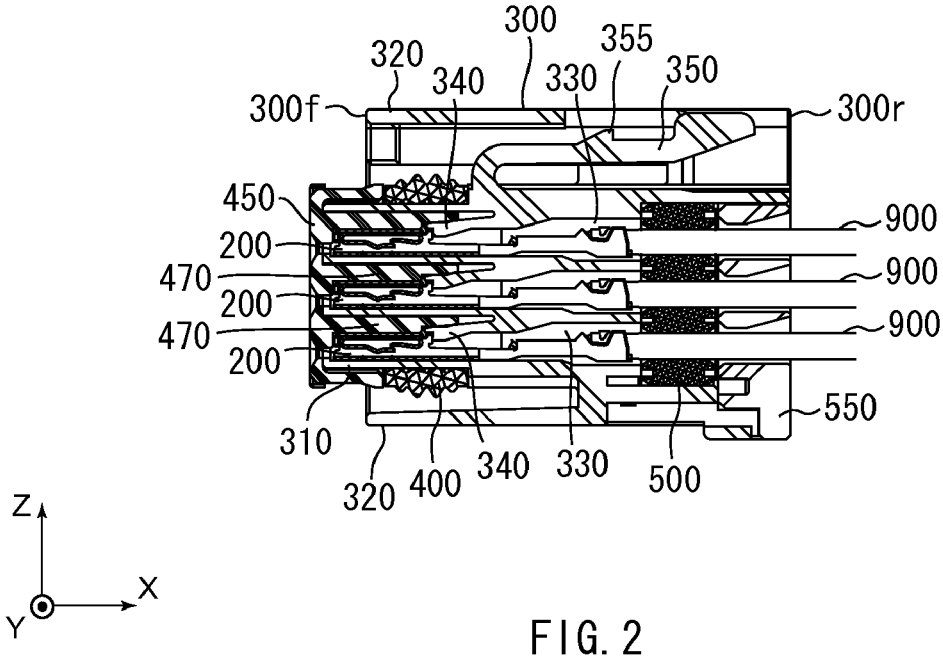
FIG. 2 is a cross-sectional view showing the first connector of FIG. 1, taken along lines II-II.
Figure 6:
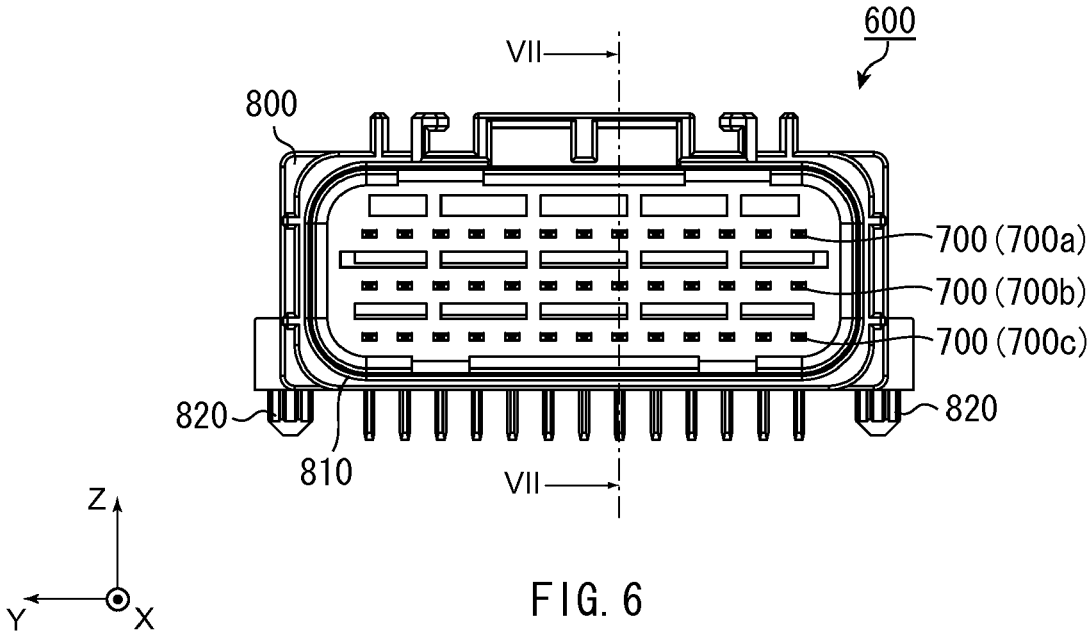
FIG. 6 is a front view showing a second connector of the connector assembly according to an embodiment of the present invention.
Figure 7:
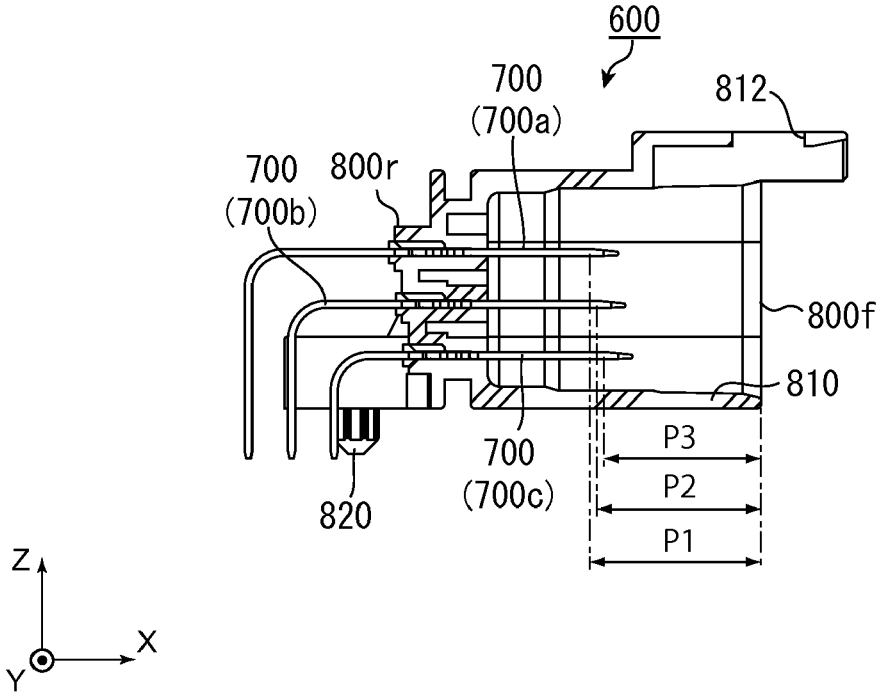
FIG. 7 is a cross-sectional view showing the second connector of FIG. 6, taken along lines VII-VII.
Figure 8:
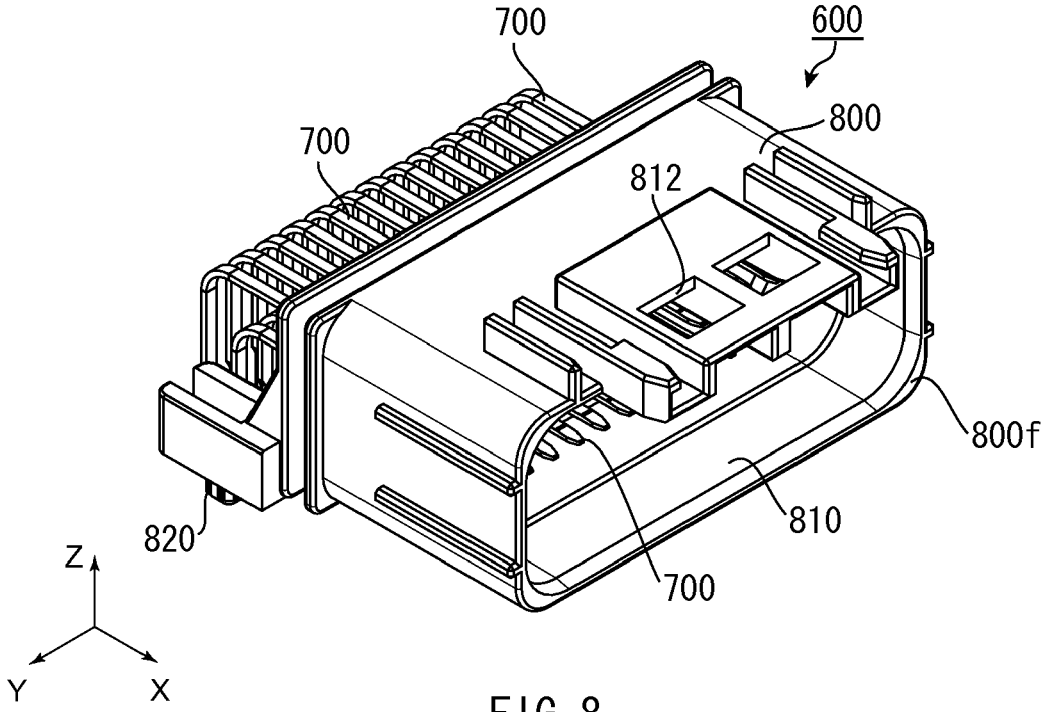
FIG. 8 is a perspective view showing the second connector of FIG. 6.

A connector assembly according to an embodiment of the present invention comprises a first connector 100 shown in FIGS. 1 and 2 and a second connector 600 shown in FIGS. 6 to 8. The connector assembly according to the present embodiment is a waterproof connector assembly. However, the present invention is applicable to a non-waterproof connector assembly.

As shown in FIGS. 1 and 2, the first connector 100 includes a plurality of female contacts 200, a first housing 300, a front sealing member 400, a front cap 450, a rear sealing member 500 and a rear cap 550. The first housing 300 holds the female contacts 200 so that the female contacts 200 extend along the insertion direction (X-direction). The first housing 300 has a front end **300*f* and a rear end 300*r* in the X-direction. Each of the front sealing member 400 and the front cap 450 is attached to the housing so as to be located near the front end 300*f*. Each of the rear sealing member 500 and the rear cap 550 is attached to the first housing 300 so as to be located near the rear end 300*r***.

Figure 3:
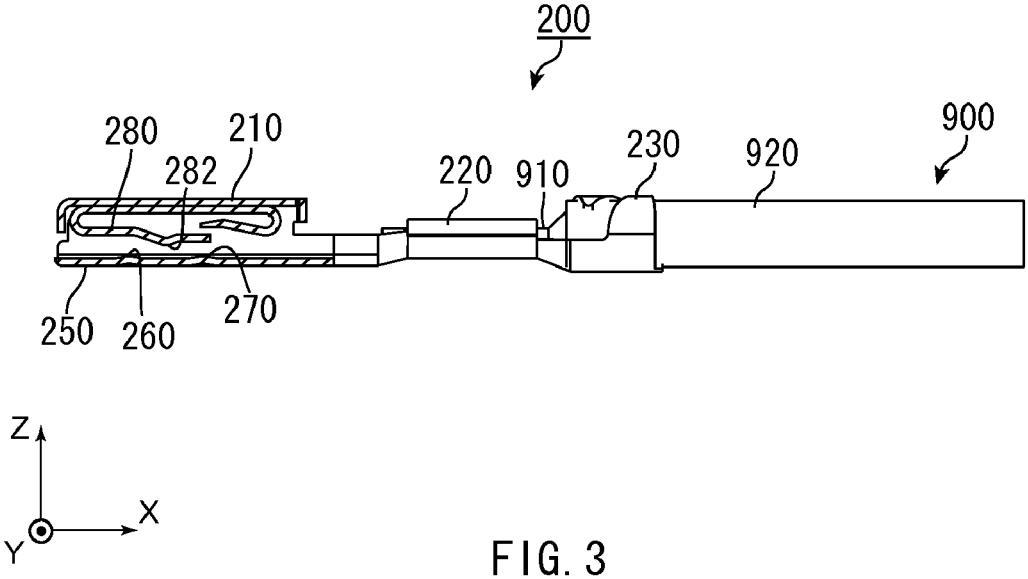
FIG. 3 is a partially-cutaway, side view showing a female contact of the first connector of FIG. 1.

As shown in FIGS. 2 and 3, the female contact 200 is configured to be connected to a cable 900 having a conducting wire 910 and an outer cover 920 covering the conducting wire 910. As can be seen from FIG. 3, each of the female contacts 200 is formed by stamping and bending a metal sheet. The female contact 200 has a receiving portion 210, a connected portion 220 and a caulking portion 230. The receiving portion 210 is shaped in a roughly square tubular shape. The connected portion 220 is configured to be connected to the conducting wire 910 of the cable 900. The caulking portion 230 is configured to caulk the outer cover 920 of the cable 900.

Figure 4:
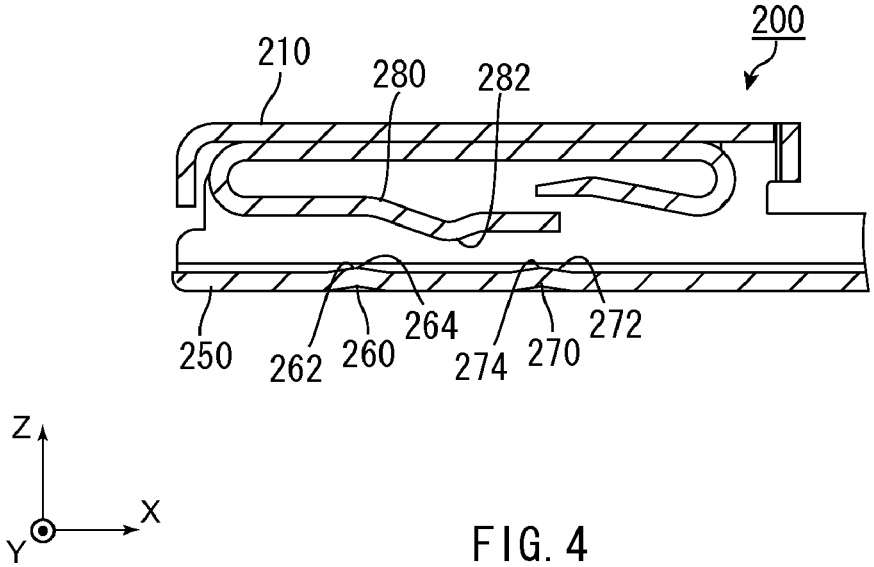
FIG. 4 is a partial, cross-sectional view showing about a receiving portion of the female contact of FIG. 3.

As shown in FIGS. 3 and 4, the receiving portion 210 of the female contact 200 has a support portion 250 and a spring portion 280. The support portion 250 is formed from a part of a bottom plate of the receiving portion 210. The support portion 250 and the spring portion 280 face each other in the vertical direction (Z-direction) perpendicular to the insertion direction. According to the present embodiment, the spring portion 280 is formed to be located above the support portion 250 in the Z-direction so that the female contact 200 is formed with a gap between the spring portion 280 and the support portion 250.

As shown in FIG. 4, the support portion 250 has an upward portion 262 and a downward portion 272 formed so as to be located apart from each other in the X-direction. Each of the upward portion 262 and the downward portion 272 has a highest point in the Z-direction. More specifically, the support portion 250 according to the present embodiment has a first protrusion 260 protruding along the positive Z-direction (i.e. protruding upward) and a second protrusion 270 protruding upward. The first protrusion 260 and the second protrusion 270 are located apart from each other in the X-direction. Each of the first protrusion 260 and the second protrusion 270 is formed with a front side slope and a rear side slope. The first protrusion 260 and the second protrusion 270 have tops 264 and 274 in the Z-direction, respectively. According to the present embodiment, the upward portion 262 and the downward portion 272 are formed on the first protrusion 260 and the second protrusion 270, respectively. In detail, the upward portion 262 is the front side slope of the first protrusion 260 while the downward portion 272 is the rear side slope of the second protrusion 270. The highest point of the upward portion 262 is the top 264 of the first protrusion 260. The highest point of the downward portion 272 is the top 274 of the second protrusion 270.

As shown in FIGS. 3 and 4, a part of an upper plate of the receiving portion 210 extends along the negative X-direction toward a front end of the receiving portion 210 while being apart from a remaining part of the upper plate of the receiving portion 210. The aforementioned extending part of the top plate is turned back so that the extending part is formed with a turning-back part located in the vicinity of the front end of the receiving portion 210 (i.e. located near an opening of the receiving portion 210). The spring portion 280 extends from the turning-back part along the positive X-direction. The spring portion 280 has a contact point 282 protruding in the negative Z-direction (i.e. protruding downward). The spring portion 280 is supported by the turning-back part so as to be elastically pivotable on the turning-back part. In other words, the contact point 282 is movable substantially in the Z-direction about the turning-back part which serves as a fulcrum. The contact point 282 is formed to be located between the highest point of the upward portion 262 and the highest point of the downward portion 272 in the X-direction. The contact point 282, the highest point of the upward portion 262 and the highest point of the downward portion 272 are arranged at three vertexes of an imaginary triangle, respectively. According to the present embodiment, the contact point 282 is located between the top 264 of the first protrusion 260 and the top 274 of the second protrusion 270 in the X-direction.

As shown in FIG. 2, the first housing 300 has a mating portion 310 and an outside cover 320. The mating portion 310 projects forward along the negative X-direction so that the mating portion 310 is formed with an outer surface extending in the X-direction while surrounding the mating portion 310. The outside cover 320 covers the outer surface of the mating portion 310 so as to be apart from the mating portion 310 in a direction perpendicular to the X-direction. The first housing 300 is provided with locking arms 350 between the mating portion 310 and the outside cover 320. Each of the locking arms 350 extends backward along the positive X-direction from a rear part of the mating portion 310. The locking arm 350 is provided with an engaging protrusion 355. The engaging protrusion 355 protrudes upward from the locking arm 350.

As shown in FIG. 2, the first housing 300 is formed with a plurality of contact-accommodating portions 330. The contact-accommodating portion 330 is configured to accommodate the female contact 200. More specifically, the contact-accommodating portion 330 pierces the first housing 300 from the rear end **300*r* to a front end of the mating portion 310. The contact-accommodating portion 330 has a lance 340 formed therewithin. The lance 340 extends forward and downward. When the female contact 200 which is inserted and accommodated in the contact-accommodating portion 330 is pulled along the positive X-direction, the lance 340 is brought into abutment with a rear end of the receiving portion 210 so that the female contact 200 is prevented from being removed backward. According to the present embodiment, the contact-accommodating portions 330 with the respective lances 340 have the same shape as one another. In addition, the female contacts 200 accommodated in the respective contact-accommodating portions 330 have the same shape as one another. Therefore, the contact points 282 of the respective spring portions 280 are positioned at the same position in the X-direction when the female contacts 200 are accommodated in the respective contact-accommodating portions 330**.

The front sealing member 400 is attached on the outer surface of the mating portion 310. The front cap 450 is attached to the front end of the mating portion 310. The front cap 450 is provided with a plurality of regulating projections 470. When the front cap 450 is attached, the regulating projections 470 are inserted into the respective contact-accommodating portions 330 so that each of the regulating projections 470 regulates a movement of the lance 340.

The rear sealing member 500 is attached to the first housing 300 from the rear end 300*r* toward the front end 300*f*. The rear sealing member 500 is formed with a plurality of through holes. The cable 900 fixed to the female contact 200 is partially located in the through hole. The rear cap 550 is attached to the first housing 300 from the rear end 300*r* toward the front end 300*f* so as to be located behind the rear sealing member 500 in the X-direction.

Figure 5:
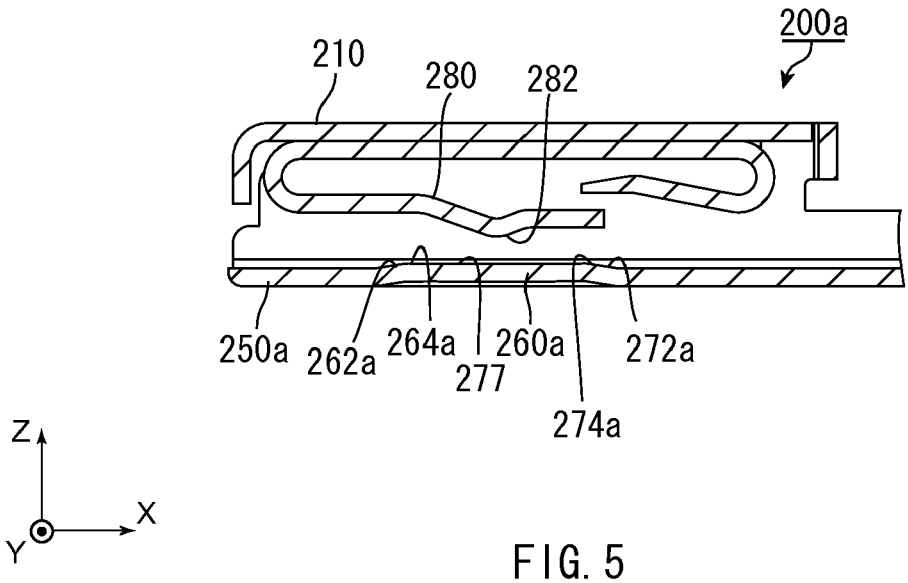
FIG. 5 is a partial, cross-sectional view showing about a receiving portion of a modification of the female contact of FIG. 3.

As described above, the support portion 250 of the female contact 200 of the first connector 100 according to the present embodiment has two protrusions, namely, the first protrusion 260 and the second protrusion 270. However, the support portion 250 may be formed differently, provided that the support portion 250 has an upward portion and a downward portion. For example, as can be seen from FIGS. 2 to 5, the first connector 100 may include a female contact 200*a* having a support portion 250*a* formed with only one protrusion 260*a*. As shown in FIG. 5, the support portion 250*a* has the protrusion 260*a* protruding upward along the positive Z-direction. The protrusion 260*a* is formed with a front side slope, a rear side slope and a flat surface 277 connecting the front side slope and the rear side slope with each other. The front side slope and the rear side slope function as an upward portion 262*a* and a downward portion 272*a*, respectively. In other words, the upward portion 262*a* and the downward portion 272*a* are formed on the protrusion 260*a*. The upward portion 262*a* and the downward portion 272*a* have highest point 264*a* and 274*a* in the Z-direction, respectively. The highest point 264*a* of the upward portion 262*a* and the highest point 274*a* of the downward portion 272*a* are placed in the flat surface 277. In other words, the highest point 264*a* and the highest point 274*a* are connected with each other by the flat surface 277.

As shown in FIGS. 6 to 8, the second connector 600 includes a plurality of male contacts 700 and a second housing 800. The second housing 800 holds the male contacts 700 so that each of the male contacts 700 is insertable into the gap of the female contact 200 along the X-direction (see FIGS. 2 and 7). The second connector 600 is configured to be mated with and connected to the first connector 100 under an inserted state where the male contacts 700 are sufficiently inserted in the female contacts 200.

Figure 9:
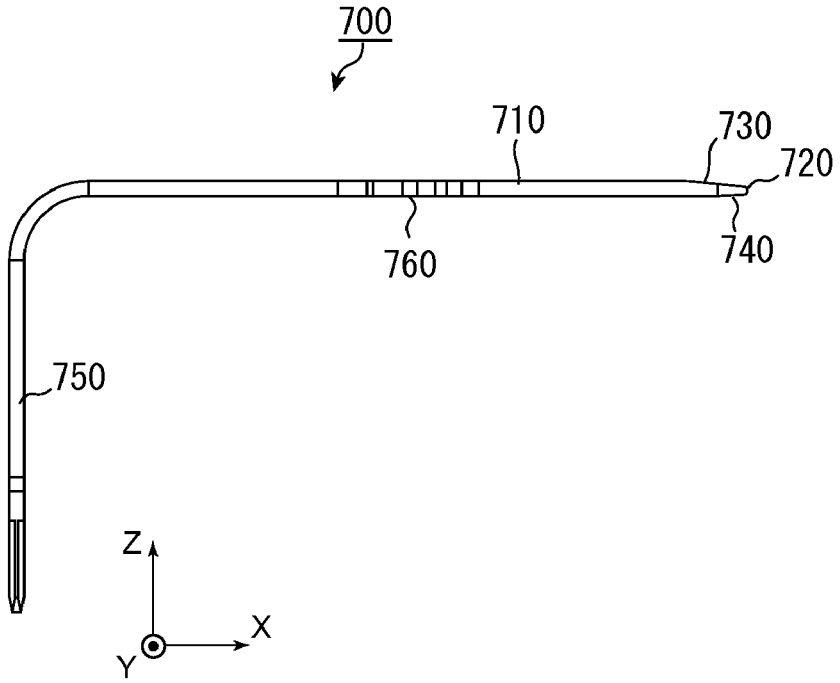
FIG. 9 is a side view showing a male contact of the second connector of FIG. 6.
Figure 10:
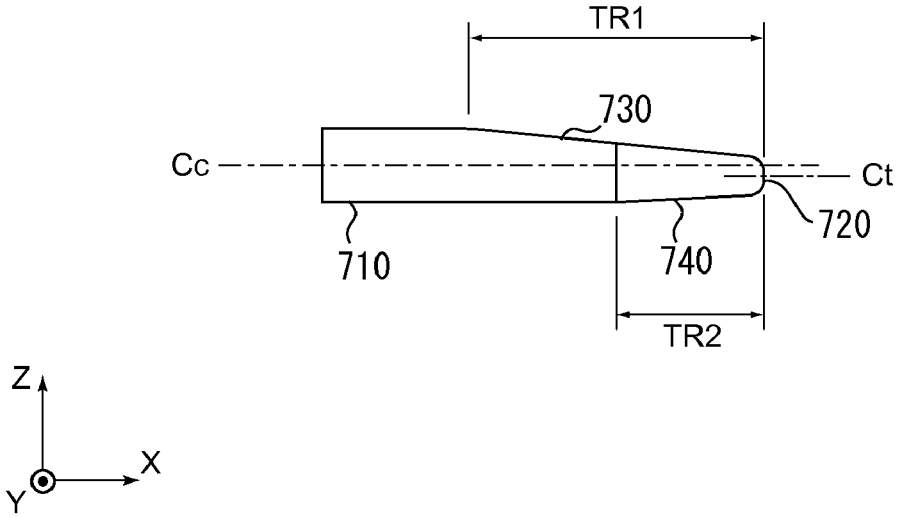
FIG. 10 is a partial, side view showing about a tip of the male contact of FIG. 9.
Figure 11:
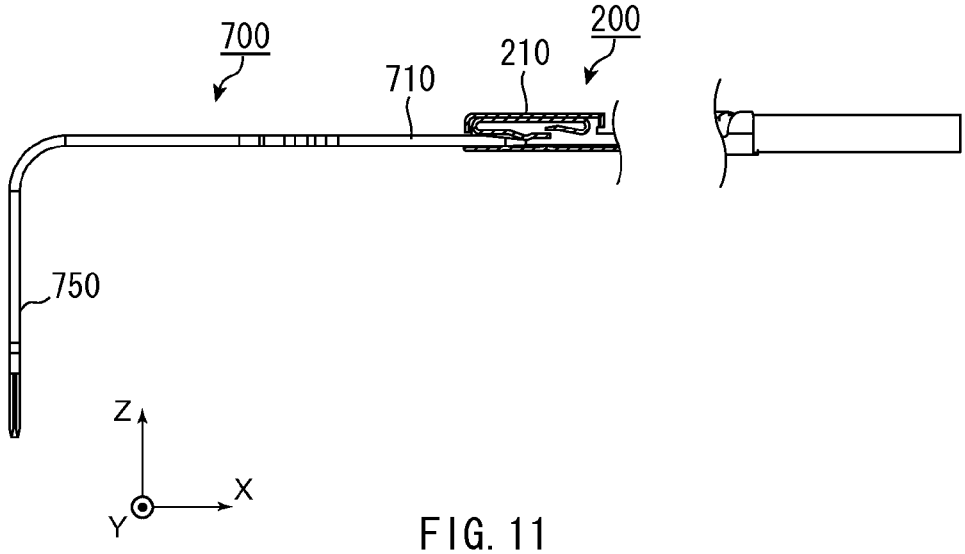
FIG. 11 is a partially-cutaway, side view showing a part of the female contact of FIG. 3 and the male contact of FIG. 9, wherein the male contact is inserted halfway in the receiving portion of the female contact.

As described later, the male contacts 700 according to the present embodiment comprise three types of male contact. In other words, the male contacts 700 according to the present embodiment are grouped into three male groups. Similarly, the female contacts 200 are grouped into three female groups corresponding to the three male groups, respectively. Three male contacts 700 belonging to different male groups have slightly different shapes to each other. However, all the male contacts 700 have the same basic form. More specifically, as shown in FIGS. 7, 9 and 10, each of the male contacts 700 is shaped in an L-like shape. In detail, each of the male contacts 700 has a held portion 760, a contact portion 710, a tip 720, an upper slope 730, a lower slope 740 and a fixed portion 750. The held portion 760 is configured to be held by the second housing 800. The contact portion 710 is configured to be connected to the female contact 200. Each of the upper slope 730 and the lower slope 740 slops from the tip 720 to the contact portion 710. The fixed portion 750 is connected and fixed to a conductor pattern of a circuit board (not shown) when the second connector 600 is mounted on the circuit board.

As shown in FIGS. 11 to 14, the male contact 700 is configured to be inserted in the receiving portion 210 of the female contact 200 so as to be connected to the female contact 200. In detail, the male contact 700 is inserted into the gap of the female contact 200 along the positive X-direction so as to be connected to the female contact 200. The male contact 700 under the inserted state is partially located, in the Z-direction, between the contact point 282 of the spring portion 280 and a pair of the top 264 of the first protrusion 260 and the top 274 of the second protrusion 270. When the male contact 700 is connected to the female contact 200 (i.e. under the inserted state), the contact point 282 and the pair of the top 264 and 274 interpose the contact portion 710 in the Z-direction. In other words, the contact portion 710 is brought into contact with and held by three points, namely, the contact point 282 of the spring portion 280, the top 264 of the first protrusion 260 and the top 274 of the second protrusion 270 under the inserted state. Therefore, it is possible to keep a stable connection of the male contact 700 to the female contact 200.

As shown in FIG. 10, the upper slope 730 extends from the tip 720 to the contact portion 710 while sloping over a first tapering range TR1. The lower slope 740 extends from the tip 720 to the contact portion 710 while sloping over a second tapering range TR2. The first tapering range TR1 is longer than the second tapering range TR2 in the X-direction. The upper slope 730 slopes gentler than the lower slope 740. According to the present embodiment, each of the upper slope 730 and the lower slope 740 has a constant angle of inclination. The constant angle of inclination of the upper slope 730 is gentler than the constant angle of inclination of the lower slope 740. The male contact 700 according to the present embodiment has an eccentric center. The eccentric center of the male contact 700 is positioned so as to be apart from the spring portion 280 under the inserted state. More specifically, as shown in FIG. 10, the contact portion 710 according to the present embodiment has a rectangular part having a regular thickness in the Z-direction as seen along the width direction (Y-direction) perpendicular both to the insertion direction and the vertical direction. As can be seen from FIGS. 10 and 14, the rectangular part of the contact portion 710 has a center (center line) Cc in the Z-direction. The tip 720 has a center Ct in the Z-direction. The center Ct of the tip 720 is located below the center Cc of the contact portion 710 in the Z-direction. In other words, under the inserted state, a distance between the center Ct and the spring portion 280 in the Z-direction is longer than a distance between the center Cc and the spring portion 280 in the Z-direction.

As shown in FIGS. 7 and 8, the second housing 800 has an accommodating portion 810 and a post 820. The accommodating portion 810 defines an accommodating space surrounded thereby. The accommodating portion 810 is configured to accommodate the mating portion 310 of the first housing 300 in the accommodating space under a mated state where the first connector 100 is mated with the second connector 600. The post 820 is engaged with and fixed to a hole formed in a circuit board (not shown) when the second connector 600 is mounted on the circuit board. The accommodating portion 810 is formed with engaged holes 812. Each of the engaged holes 812 pierces an upper plate of the accommodating portion 810 along the Z-direction. The accommodating portion 810 is inserted between the mating portion 310 and the outside cover 320 of the first housing 300 under the mated state. When the accommodating portion 810 is inserted in the first housing 300, the engaging protrusion 355 of the locking arm 350 of the first housing 300 is located in the engaged hole 812 of the accommodating portion 810 so that the mated state of the first connector 100 with the second connector 600 is locked.

As shown in FIGS. 6 and 7, the second housing 800 has a front end 800*f* and a rear end 800*r*. The rear end 800*r* is formed with a plurality of holes piercing a rear part of the second housing 800 along the X-direction from the rear end 800*r* to the inside of the accommodating space surrounded by the accommodating portion 810. According to the present embodiment, the holes are grouped into three groups. In detail, the second housing 800 has upper holes formed at an upper portion of the rear end 800*r*, middle holes formed at a middle portion of the rear end 800*r* and lower holes formed at a lower portion of the rear end 800*r*. Each of the male contacts 700 is held by one of the upper hole, the middle hole and the lower hole. In other words, the male contacts 700 are held by the second housing 800 so as to be arranged in three rows, namely, an upper row, a middle row and a lower low. The male contact 700 is press fitted into the hole from the rear end 800*r* of the second housing 800 so that the tip 720 is located within the accommodating space surrounded by the accommodating portion 810. According to the present embodiment, as previously described, the male contact 700 arranged in the upper row (hereinafter, referred to as the male contact 700*a*), the male contact 700 arranged in the middle row (hereinafter, referred to as the male contact 700*b*) and the male contact 700 arranged in the lower row (hereinafter, referred to as the male contact 700*c*) have the roughly same shape while having different sizes to one another. Moreover, according to the present embodiment, the male contacts 700*a*, 700*b* and 700*c* have different distances P1, P2 and P3, respectively, wherein each of the distances P1, P2 and P3 is a distance from a border (upper border) between the upper slope 730 and the contact portion 710 (see FIGS. 7 and 10) to a front end of the accommodating portion 810 (i.e. the front end 800*f* of the second housing 800). More specifically, the distance P1 of the male contact 700*a* is longer than the distance P2 of the male contact 700*b*. The distance P2 is longer than the distance P3 of the male contact 700*c*. In short, the distances P1, P2 and P3 satisfy the inequality, P1>P2>P3.

Figure 15:
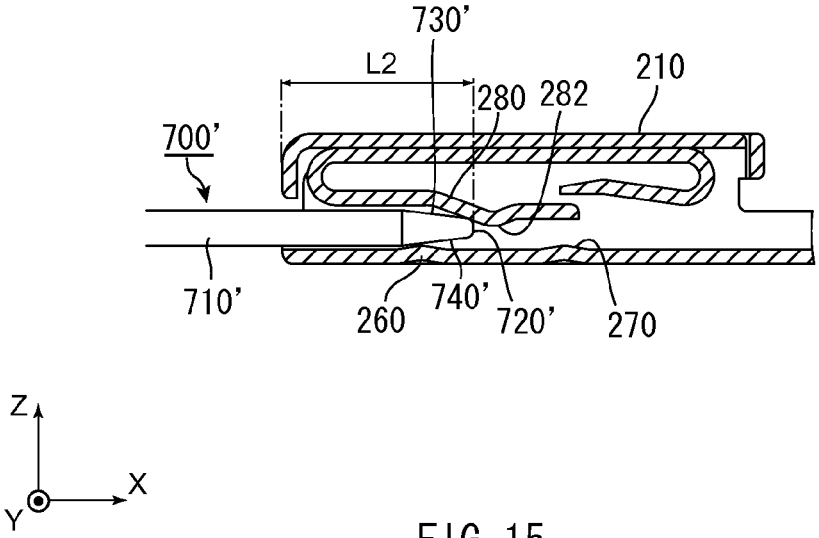
FIG. 15 is a partial, cross-sectional view showing about the receiving portion of the female contact of FIG. 3, wherein an existing male contact is inserted halfway in the receiving portion of the female contact.

As shown in FIG. 15, an existing male contact 700' is able to be inserted into the female contact 200 according to the present embodiment. The existing male contact 700' has a contact portion 710', a tip 720', an upper slope 730' and a lower slope 740'. The contact portion 710' and the tip 720' are configured similar to the contact portion 710 and the tip 720, respectively. The upper slope 730' and the lower slope 740' slope over the same tapering range.

Figure 12:
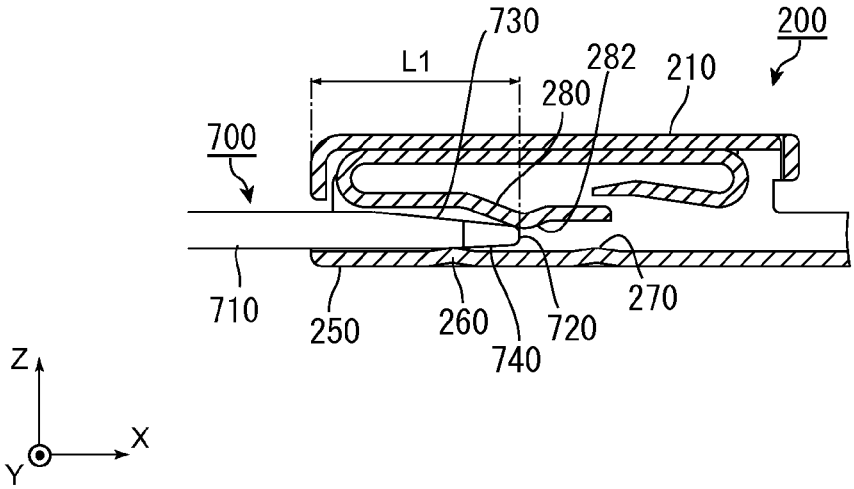
FIG. 12 is a partial, cross-sectional view showing about the receiving portion of FIG. 11.
Figure 16:
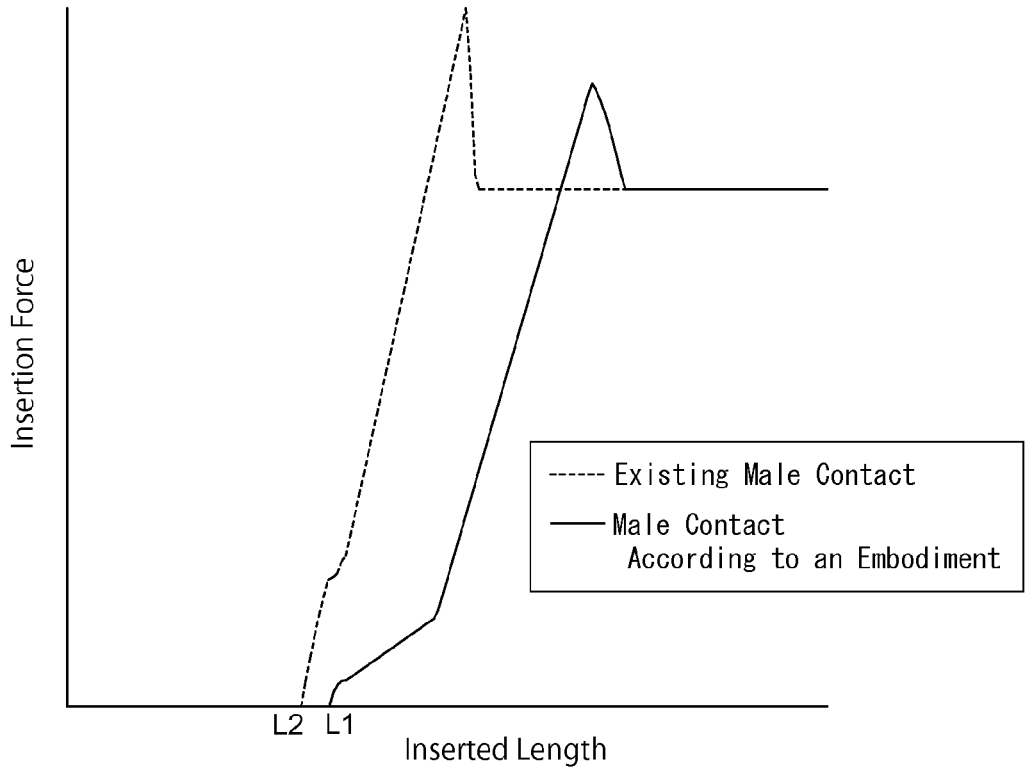
FIG. 16 is a graph showing a relation between an inserted length and an insertion force, wherein the inserted length is a length of an inserted part of a male contact in the female contact, and the insertion force is a force required to insert the male contact into the female contact.

As shown in FIG. 12, the tip 720 of the male contact 700 is initially brought into contact with the spring portion 280 when the tip 720 inserted into the female contact 200 arrives at an initial abutment location which is a distance L1 away from an opening of the female contact 200 in the X-direction. On the other hand, as shown in FIG. 15, the tip 720' of the existing male contact 700' is initially brought into contact with the spring portion 280 when the tip 720' inserted into the female contact 200 arrives at the usual, initial abutment location which is a distance L2 away from the opening of the female contact 200 in the X-direction. As previously described, the center Ct of the male contact 700 according to the present embodiment is designed so as to be far away from the spring portion 280 of the female contact 200 in the Z-direction under the inserted state. Therefore, as shown in FIGS. 12 and 15, the distance L1 is longer than the distance L2. The distance L2 is shorter than the distance L1 so that a distance between the usual, initial abutment location of the tip 720' and the fulcrum (the turning-back part) of the spring portion 280 is shorter than a distance between the initial abutment location of the tip 720 and the fulcrum of the spring portion 280. In other words, as compared with a part which is initially brought into contact with the tip 720, the tip 720' pushes a part which is nearer to the fulcrum of the spring portion 280 when the tip 720' is initially brought into contact with the spring portion 280. Therefore, a larger insertion force is required to insert the existing male contact 700' into the female contact 200 while moving the spring portion 280 in the positive Z-direction. On the other hand, the tip 720 according to the present embodiment is initially brought into contact with the part of the spring portion 280 which is in the vicinity of the contact point 282 so that the tip 720 moves the spring portion 280 more efficiently. According to the present embodiment, it is possible to reduce an initial insertion force which is required to deform or move the spring portion 280 when the tip 720 is brought into contact with the spring portion 280 at the initial abutment location. Moreover, it is possible to change or increase an insertion force gradually. FIG. 16 shows the insertion force required to insert the male contact 700 into the female contact 200 and the usual insertion force required to insert the existing male contact 700' into the female contact 200. The elasticity of the spring portion 280 is used more efficiently in a case that the male contact 700 according to the present embodiment is inserted into and connected to the female contact 200 as compared with a case that the existing male contact 700' is inserted into and connected to the female contact 200. According to the present embodiment, as shown in FIG. 16, the initial insertion force may be reduced (see starting parts of inclining lines in FIG. 16).

According to the present embodiment, the first tapering range TR1 of the upper slope 730 to which the spring portion 280 applies an elastic force is longer in the X-direction than the second tapering range TR2 of the lower slope 740 which is not brought into contact with the spring portion 280. In addition, the angle of inclination of the upper slope 730 is gentler than the angle of inclination of the lower slope 740. Therefore, the male contact 700 is able to be inserted into the female contact 200 more smoothly. More specifically, as shown in FIG. 16, it is possible to make the insertion force of the male contact 700 to change more gradually (see inclinations before peeks of lines in FIG. 16).

Moreover, as shown in FIG. 16, it is possible to reduce the peak of the insertion force as a combined effect of the present embodiment.

Figure 13:
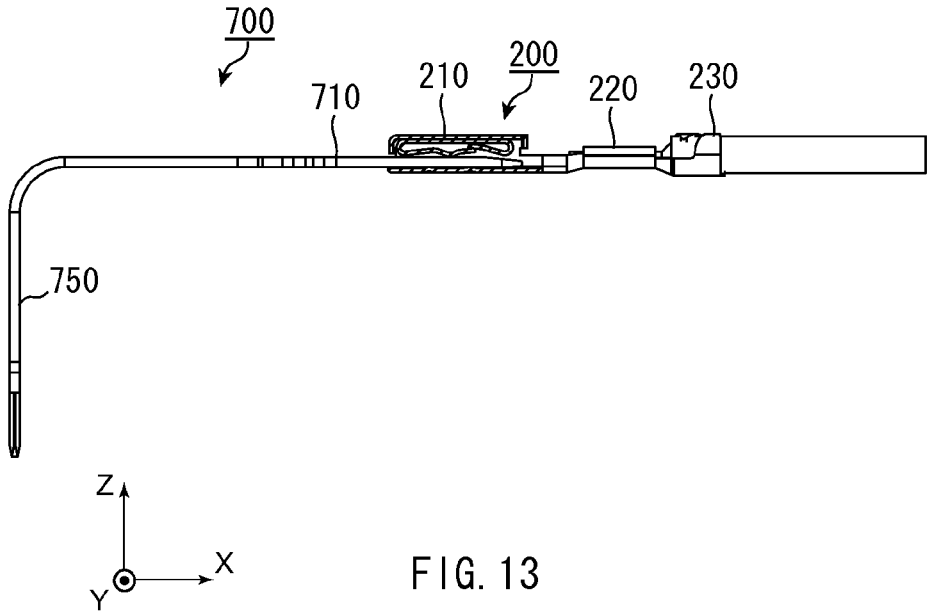
FIG. 13 is a partially-cutaway, side view showing the female contact of FIG. 3 and the male contact of FIG. 9, wherein the male contact and the female contact are connected to each other.
Figure 14:
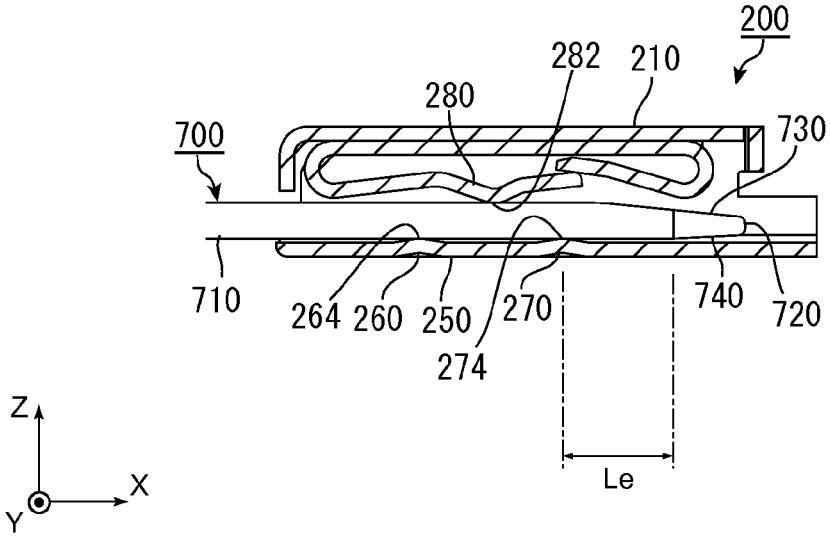
FIG. 14 is a partial, cross-sectional view showing about the receiving portion of FIG. 13.

As shown in FIGS. 13 and 14, when the male contact 700 is completely inserted in the female contact 200, a border (lower border) between the contact portion 710 and the lower slope 740 is inserted beyond the second protrusion 270. The second protrusion 270 and the lower border define an effective contact length Le therebetween in the X-direction. According to the present embodiment, it is possible to make the effective contact length Le sufficiently long. Therefore, the reliability of a connected state of the male contact 700 to the female contact 200 can be improved.

Figure 17:
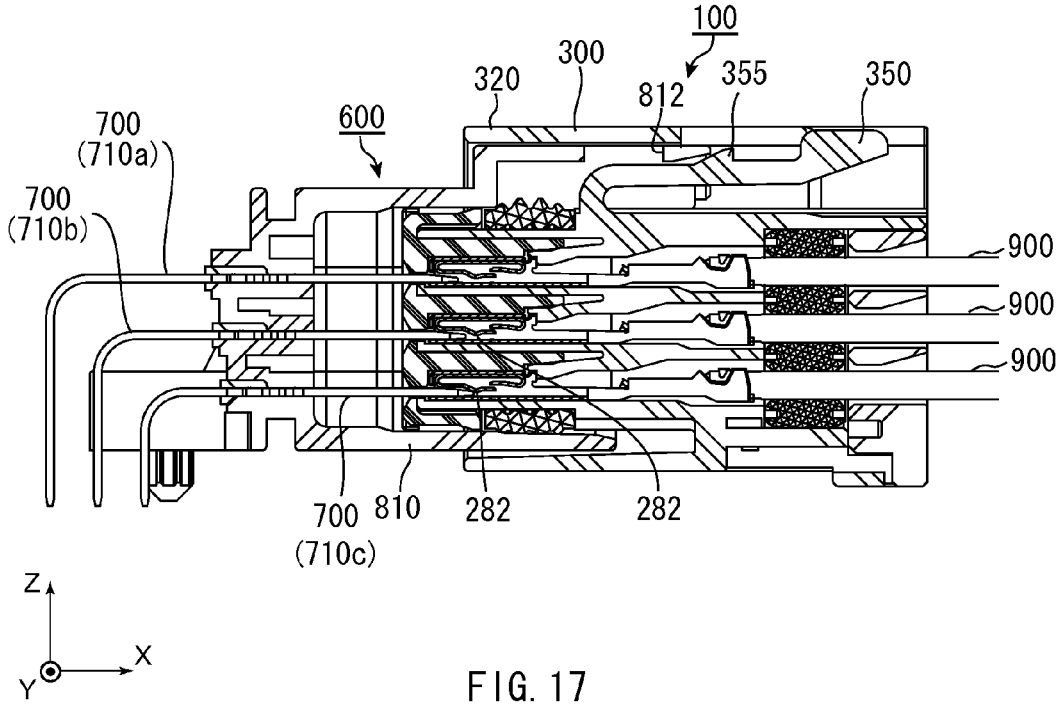
FIG. 17 is a cross-sectional view showing the first connector of FIG. 2 and the second connector of FIG. 7, wherein the first connector is inserted halfway in the second connector.
Figure 18:
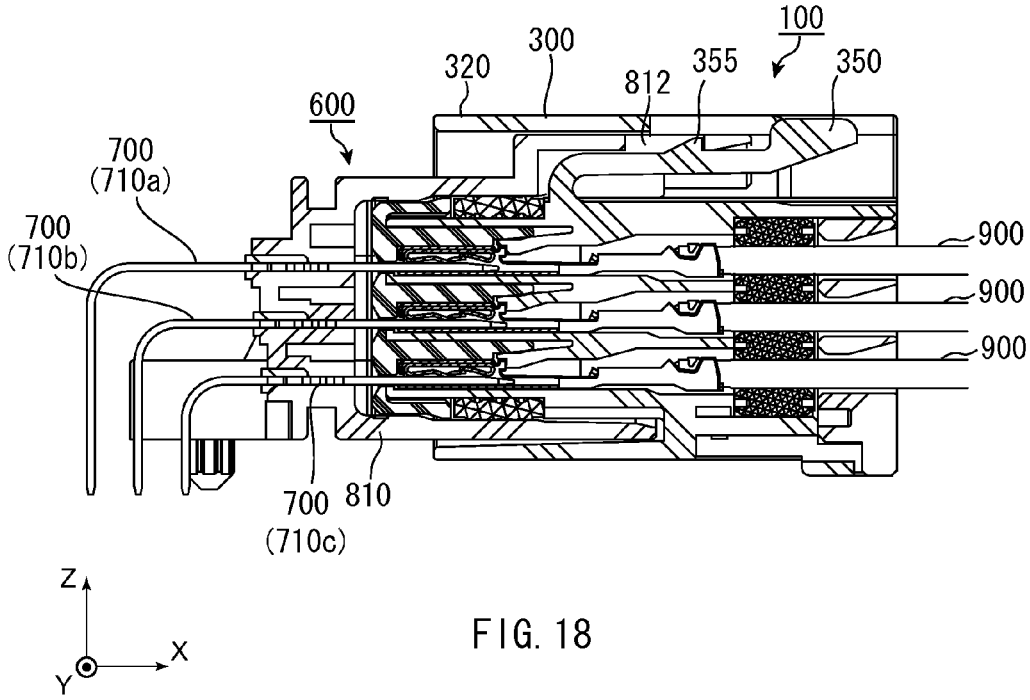
FIG. 18 is a cross-sectional view showing the first connector of FIG. 2 and the second connector of FIG. 7, wherein the first connector is mated with the second connector.

According to the present embodiment, the insertion force of each of the male contacts 700 peaks when the upper border between the upper slope 730 and the contact portion 710 of the male contact 700 moves over the contact point 282 of the spring portion 280 of the female contact 200. As shown in FIGS. 17 and 18, according to the present embodiment, while the female contacts 200 are shaped same as each other and positioned at the same position in the X-direction, the male contacts 700*a*, 700*b* and 700*c* held by the respective three rows of the rear end 800*r* are differently shaped and positioned. In other words, the male contacts 700*a*, 700*b* and 700*c* belong to the three male groups, respectively. The female contacts 200 connected to the male contacts 700*a*, 700*b* and 700*c* belong to the three female groups, respectively. According to the present embodiment, the male contacts 700*a*, 700*b* and 700*c* have different distances P1, P2 and P3, respectively, so that the upper borders of the male contacts 700*a*, 700*b* and 700*c* move over the respective contact points 282 at different timings from one another. In detail, at a first timing, the contact portion 710 of the male contact 700 belonging to one of the male groups is brought into contact with the contact point 282 of the female contact 200 belonging to the female group which corresponds to the aforementioned one of the male groups. At a second timing, the contact portion 710 of the male contact 700 belonging to a remaining one of the male groups is brought into contact with the contact point 282 of the female contact 200 belonging to the female group which corresponds to the aforementioned remaining one of the male groups. The female contacts 200 and the male contacts 700 are arranged so that the first timing is different from the second timing. As can be seen from the above description, according to the present embodiment, the insertion forces of the male contacts 700*a*, 700*b* and 700*c* arranged in the upper row, the middle row and the lower row peak at different timings, respectively. Therefore, regarding to a total insertion force of the connector assembly (i.e. the summation of the insertion forces of all the male contacts 700), as compared with a case where the insertion forces of all the male contacts 700 peak at the same time, the temporary, maximum value of the total insertion force can be reduced.

According to the present embodiment, the male contact 700*a*, 700*b* and 700*c* are shaped and arranged differently so that the peak timings of the insertion forces are distributed. However, the peak timings may be distributed in other ways. For example, the female contacts 200 may be shaped or arranged differently.

The present application is based on a Japanese patent application of JP2010-222461 filed before the Japan Patent Office on Sep. 30, 2010, the contents of which are incorporated herein by reference.

While there has been described what is believed to be the preferred embodiment of the invention, those skilled in the art will recognize that other and further modifications may be made thereto without departing from the spirit of the invention, and it is intended to claim all such embodiments that fall within the true scope of the invention.

What is claimed is:

1. A connector assembly comprising:

a first connector including a female contact and a first housing, the first housing holding the female contact so that the female contact extends along an insertion direction, the female contact having a support portion and a spring portion, the spring portion being formed to be located above the support portion in a vertical direction perpendicular to the insertion direction so that the female contact is formed with a gap between the spring portion and the support portion, the support portion having an upward portion and a downward portion formed so as to be located apart from each other in the insertion direction, each of the upward portion and the downward portion having a highest point in the vertical direction, the spring portion having a contact point formed to be located between the highest point of the upward portion and the highest point of the downward portion in the insertion direction; and a second connector including a male contact and a second housing, the second housing holding the male contact so that the male contact is insertable into the gap of the female contact along the insertion direction, the second connector being configured to be mated with and connected to the first connector under an inserted state where the male contact is inserted in the female contact, the male contact having a contact portion, a tip, an upper slope and a lower slope, the contact portion being brought into contact with the contact point, the highest point of the upward portion and the highest point of the downward portion under the inserted state, the upper slope extending from the tip to the contact portion while sloping over a first tapering range, the lower slope extending from the tip to the contact portion while sloping over a second tapering range, the first tapering range being longer than the second tapering range in the insertion direction.

2. The connector assembly as recited in claim 1, wherein:

each of the tip and the contact portion has a center in the vertical direction;

the center of the tip is located below the center of the contact portion in the vertical direction.

3. The connector assembly as recited in claim 1, wherein the upper slope slopes gentler than the lower slope.

4. The connector assembly as recited in claim 1, wherein:

the support portion has a first protrusion protruding upward and a second protrusion protruding upward, the first protrusion and the second protrusion being located apart from each other in the insertion direction;

the highest point of the upward portion is a top of the first protrusion; and the highest point of the downward portion is a top of the second protrusion.

5. The connector assembly as recited in claim 1, wherein:

the support portion has a protrusion protruding upward;

the protrusion is formed with a flat surface;

the upward portion and the downward portion are formed on the protrusion; and the highest point of the upward portion and the highest point of the downward portion are placed in the flat surface.

6. The connector assembly as recited in claim 1, wherein:

the first connector includes a plurality of the female contacts, the female contacts being grouped into a plurality of female groups;

the second connector includes a plurality of the male contacts, the male contacts being grouped into a plurality of male groups;

at a first timing, the contact portion of the male contact belonging to one of the male groups is brought into contact with the contact point of the female contact belonging to the female group which corresponds to said one of the male groups, at a second timing, the contact portion of the male contact belonging to a remaining one of the male groups is brought into contact with the contact point of the female contact belonging to the female group which corresponds to said remaining one of the male groups;

the female contacts and the male contacts are arranged so that the first timing is different from the second timing.

* * * * *